United States Patent [19]

Aiba

[11] Patent Number: 4,988,088

[45] Date of Patent: Jan. 29, 1991

[54] SHEET TURNING DEVICE

[75] Inventor: Masahiko Aiba, Nara, Japan

[73] Assignee: Sharp Kabushiki Kaisha, Osaka, Japan

[21] Appl. No.: 430,148

[22] Filed: Nov. 1, 1989

[30] Foreign Application Priority Data

Nov. 4, 1988 [JP] Japan ..... 63-279145

[51] Int. Cl.[5] ..... B65H 29/00

[52] U.S. Cl. ..... 271/186

[58] Field of Search ..... 271/119, 184–186, 271/196, 225; 355/318, 319

[56] References Cited

U.S. PATENT DOCUMENTS

| | | | |
|---|---|---|---|
| 4,019,435 | 4/1977 | Davis | 271/186 |
| 4,027,870 | 6/1977 | Frech et al. | 271/186 |
| 4,155,440 | 5/1979 | Bogdanski et al. | 271/185 |
| 4,903,043 | 2/1990 | Tojima | 271/185 |

FOREIGN PATENT DOCUMENTS

| | | | |
|---|---|---|---|
| 57759 | 5/1979 | Japan | 271/186 |
| 55-22787 | 6/1980 | Japan . | |

OTHER PUBLICATIONS

Aquaviva, "Document Reverter", *Xerox Disclosure Journal,* vol. 7, No. 1, Jan./Feb. 1982, pp. 11–12.

*Primary Examiner*—H. Grant Skaggs
*Assistant Examiner*—Steven M. Reiss
*Attorney, Agent, or Firm*—Birch, Stewart, Kolasch & Birch

[57] ABSTRACT

A sheet turning device in a sheet transporting path for receiving a sheet transported in a predetermined direction, turning the sheet and transporting the sheet in the predetermined direction. A pair of rollers are provided with a belt extending between the rollers for turning the sheet. A switch is provided for stopping the sheet transported onto the lower inner surface of the sheet turning belt. A driving shaft circulates the sheet turning belt to transport the sheet kept on the lower inner surface of the sheet turning belt in a direction orthogonal to the predetermined direction. A pressing member is provided for stopping and pressing the sheet on the upper inner surface of the sheet turning belt, and a sheet transporting roller for transporting the sheet pressed by the pressing member in the predetermined direction.

8 Claims, 6 Drawing Sheets

SHEET TURNING DEVICE

BACKGROUND OF THE INVENTION

1. Field of the Invention

The present imvention relates to a device for turning a sheet of paper and, more specifically, to such a device usable for copying on both sides of a sheet of paper in a copying machine.

2. Disclosure of the Background Art

An image formation apparatus, such as a copying machine or a laser printer, capable of forming an image on both sides of a sheet of paper is commercially available. In such an image formation apparatus, the sheet must be turned. For that purpose, a switchback type sheet turning device as shown in FIG. 6, for example, is commonly employed. The sheet turning apparatus is provided with a sheet transporting path 52, which makes a loop-shaped path with a printing unit 51 therein, to transport the sheet in the counterclockwise direction in the figure. The sheet is turned in the course of the circulation in the sheet transporting path 52 by rollers 53 which rotates in both the forward and reverse directions. Specifically, after printed with an image on one side in the printing unit 51, the sheet is transported to the rolllers 53 and moved by the rollers 53 until the tail portion of the sheet is nipped by the rollers 53. Then, the sheet is stopped once and transported with its original tail portion first by reverse rotation of the rollers 53. Since the sheet is turned by the transportation through which the original tail portion of the sheet goes first, the other side of the sheet is then formed with an original image when the sheet is transported through the printing unit 51 again. After that, the sheet with two images on both sides is discharged onto a sheet receiver 54 by the forward rotation of the rollers 53.

When a two-sided copy is carried out with the above device turning the sheet, the directions of the images on both sides of the sheet may be opposite to each other. For example, in the case where a direction of the sheet transportation is the same as that of the images, an image shown in a solid line in FIG. 7 is made on the first face of the sheet which is transported in the direction of an arrow A shown in FIG. 7. However, after the rollers 53 turns the sheet so that the tail of the sheet goes first, the sheet is transported in direction of an arrow B. Therefore, the direction of the image formed on a second face of the sheet is opposite to that of the image on the first face as can be seen from an illustration of a broken line in FIG. 7.

In order to solve the above disadvantage, image information stored in memory can be read from the end of the information in, for example, a laser printer. In this manner, however, the control must be complicated.

Transporting a sheet in a direction orthogonal to the transporting direction may come to turn the sheet as proposed in Japanese Examined Patent Publication No. 22787/1980. According to the description of the publication, first a sheet having an image on one side is turned so that the first character train in the image goes first, that is, the sheet is turned in a direction opposite to the predetermined direction when the image is automatically copied on both sides of the sheet through a copying machine. Second after the sheet goes through a fuser, the sheet is received by the sheet turning device. In the device, the sheet is transported in a direction orthogonal to the predetermined direction so that one side of the sheet goes first, and then the sheet is turned.

Third, the sheet is transported in the predetermined direction so that the original head of the sheet goes first, and then the sheet is turned. Fourth, the sheet is transported in order to copy an image on the second face of the sheet. Fifth, the sheet having two images on both sides is received from the fuser by the sheet turning device and turned. After that, the sheet is transported to a sorter.

SUMMARY OF THE INVENTION

The present invention provides a sheet turning device in a sheet transporting path for receiving a sheet transported in a predetermined direction, turning the sheet and transporting the sheet in the direction, comprising a pair of rollers disposed on opposite sides of the sheet transporting path along the predetermined direction; a belt extending between the rollers for turning the sheet; means for stopping the sheet transported onto the lower inner surface of the belt; means for circulating the belt to transport the sheet kept on the lower inner surface of the belt in a direction orthogonal to the predetermined direction so that the sheet turns; a pressing member for stopping and pressing the sheet which is turning and moving, on the upper inner surface of the belt; and a sheet transporting roller for pressing the sheet against the pressing member to transport the sheet pressed by the pressing member in the predetermined direction in spite of pressing the sheet against the upper inner surface by the pressing member.

Since the device according to the present invention has the pair of rollers and the sheet turning belt therebetween in the sheet transporting path, the transported sheet is moved upward by the inner surface of the belt in a direction orthogonal to the predetermined direction so that it is turned. The turning of the sheet is carried out not in a direction identical with the predetermined direction but in a direction orthogonal to the predetermined direction, so that the sheet can be turned without changing the head and tail of the sheet.

When the sheet is turned, the sheet moves upward on the inner surface of the sheet turning belt, so that the sheet must be on the upper inner surface of the belt. In order to keep the sheet, the device according to the present invention has the pressing member for pressing the upper inner surface of the sheet turning belt. Since the pressing member is placed inside the sheet turning belt, the device can be miniaturized.

BRIEF DESCRIPTION OF THE DRAWINGS

FIG. 1 is plan view, FIG. 2 is an elevational view and FIG. 3 is a side view seen from the right;

DETAILED DESCRIPTION OF THE PREFERRED EMBODIMENTS

Figure 5:
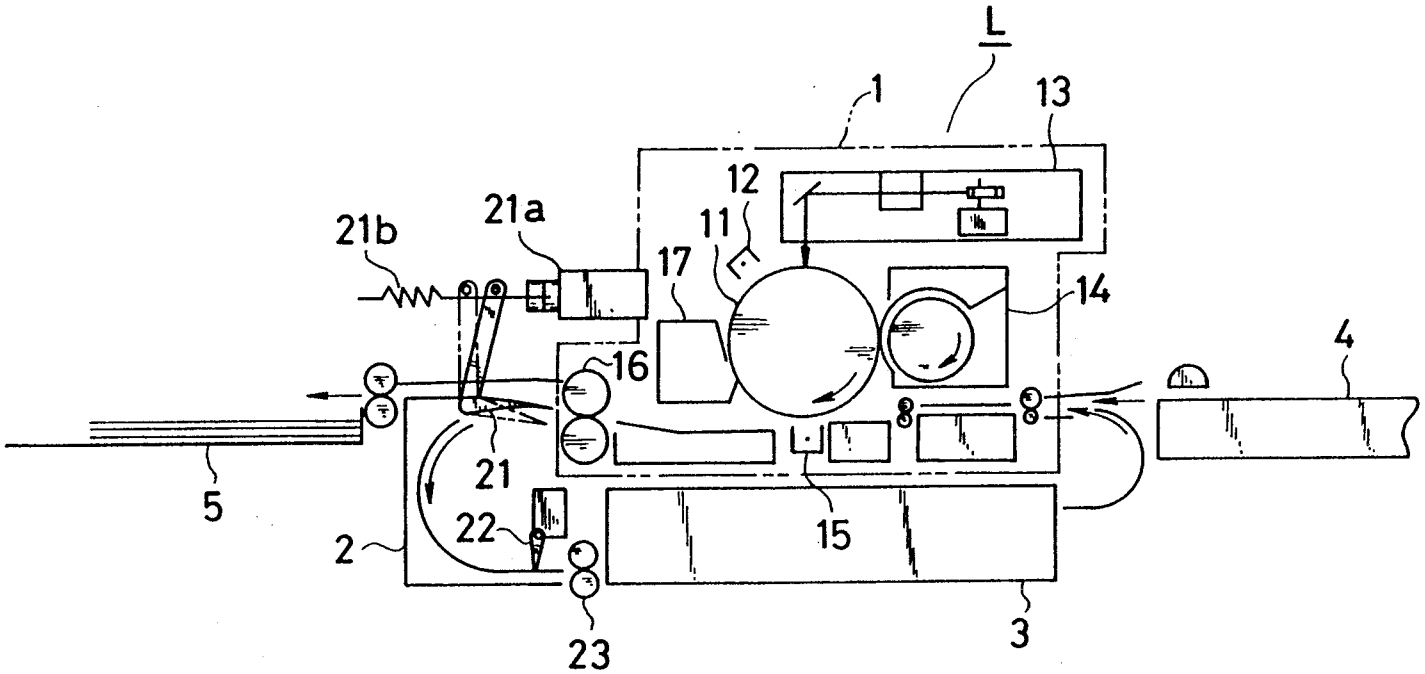
FIG. 5 PRIOR ART
FIG. 5 is a view showing a main portion of a laser printer applied to the sheet turning device.
Figure 6:
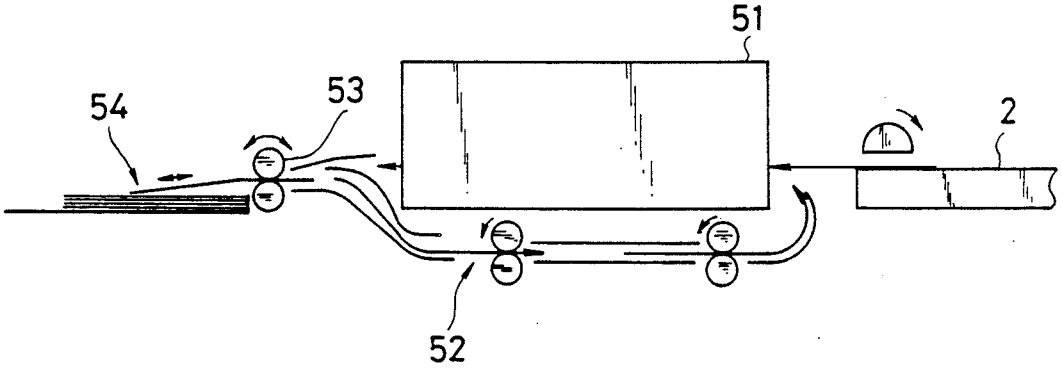
FIG. 6 PRIOR ART
FIG. 6 is a view showing a sheet turning mechanism of a prior art embodiment.
Figure 7:
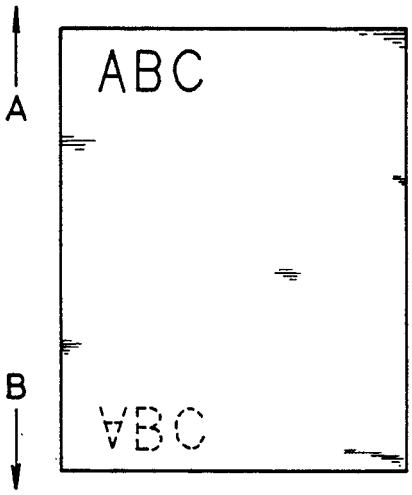
FIG. 7 PRIOR ART
FIG. 7 is a view showing an example of an image produced when a sheet is turned by the prior art sheet turning device.

FIG. 5 is a schematic view showing a constitution of a main portion of a laser printed L having a sheet turning device which is an embodiment according to the present invention.

The laser printer L comprises a printing unit 1, a sheet circulating unit 2, a sheet turning unit (a sheet turning device) 3, a sheet tray 4 and a sheet receiver 5.

The printing unit 1 includes a photoconductive drum 11 made of photosensitive substance and a processig unit provided on the peripheral portion of the drum 11 for producing an image. The printing unit 1 produces an image on the upper side of a sheet fed from the sheet tray 4 or the sheet circulating unit 2. An electrifying device 12 for uniformly establishing static electric charge on the surface of the photoconductive drum 11, a laser unit 13 for directing light to the charged photoconductive drum 11 to make a latent image thereon, a developing unit 14 for depositing toner on the latent image and making it visible by development, a transferring unit 15 for transferring the image of toner to paper and a cleaner 17 for eliminating the toner remaining on the photoconductive drum 11 are disposed in that order, surrounding the photoconductive drum 11, to produce an image with toner on a sheet of paper. The image of toner is fused on the sheet by a fuser 16, and then the sheet is transported to the sheet circulating unit 2.

The sheet circulating unit 2 receives the sheet from the fuser 16, transports the sheet in the counterclockwise direction so as to pass it under the printing unit 1 and further transports it through the sheet turning device 3 to the printing unit 1 again. The sheet circulating unit 2 is provided with a flap 21 close to the fuser 16. The flap 21 sorts sheets fed from the fuser 16 upward and downward by virtue of a solenoid 21*a* and a return spring 21*b*. A sheet guided upward is transported to the sheet receiver 5, and a sheet guided downward is transported to the printing unit 1 again through the sheet turning device 3. The sheet turning device turns the sheet. The sheet turning device has a microswitch 22 serving as a sheet stopper and a feeding roller 23 in its inlet.

Figure 1:
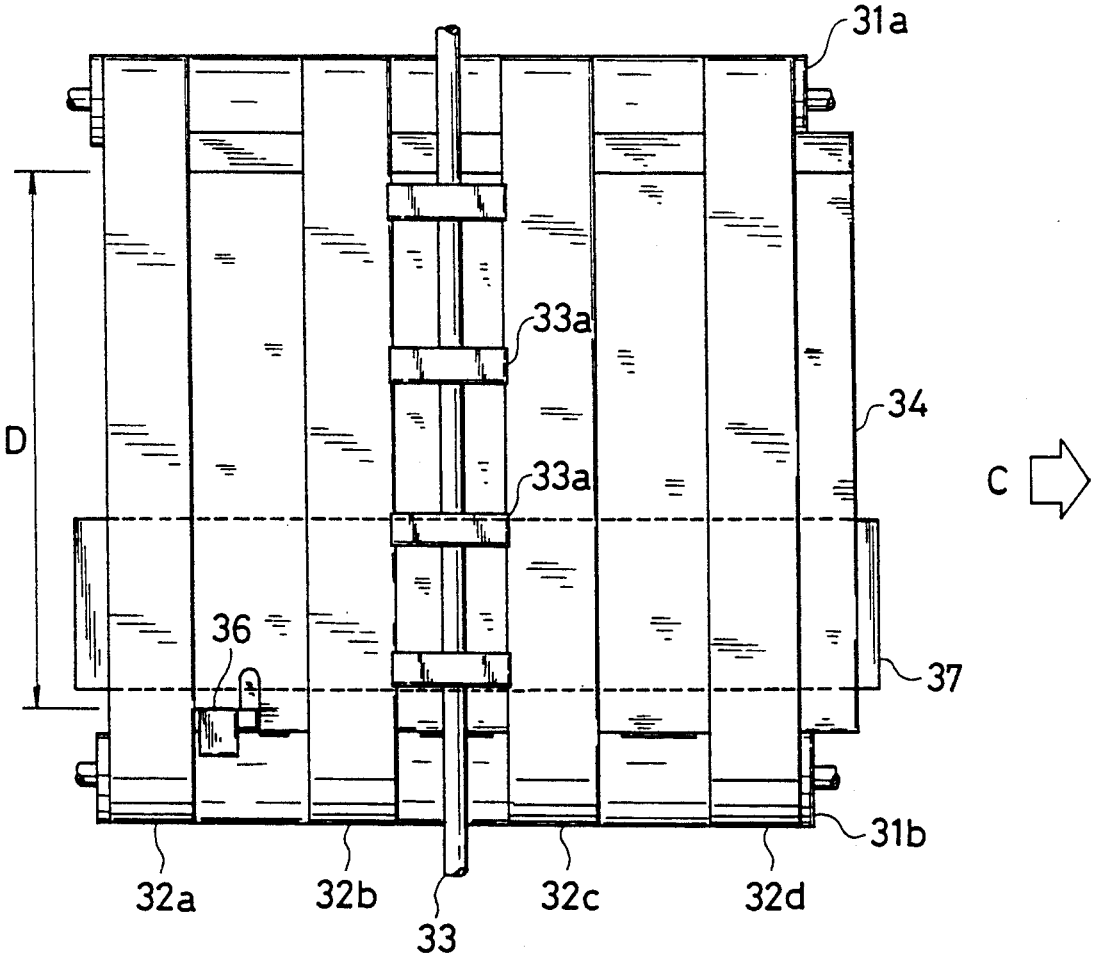
FIGS. 1 to 3 are views showing a constitution of a sheet turning device which is an embodiment according to the present imvention.
Figure 2:
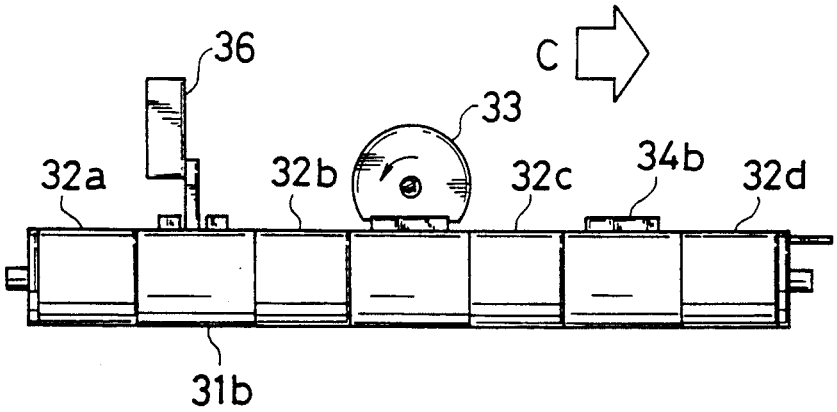
Figure 3:
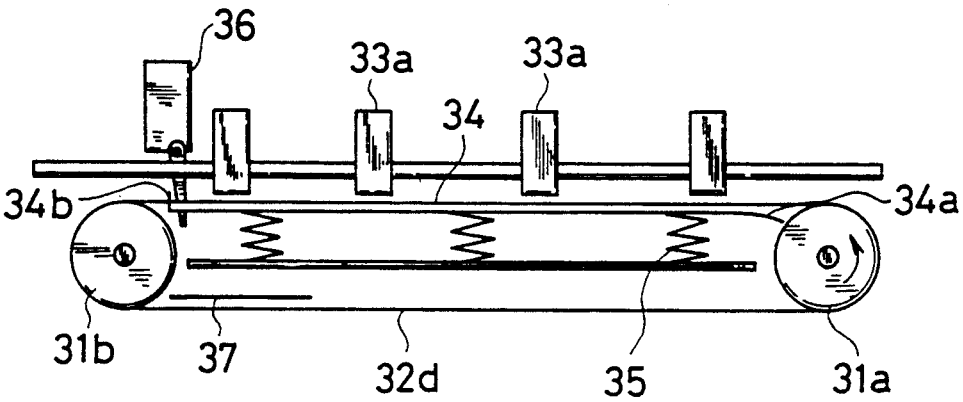

FIGS. 1 to 3 are views showing a constitution of the sheet turning device 3: FIG. 1 is a plan view, FIG. 2 is an elevational view and FIG. 3 is a side view seen from the right.

Arrow C in those figures denotes a predetermined direction in which the sheet circulating unit 3 transports a sheet. Reference character D in FIG. 1 denotes a sheet transporting path in the sheet circulating unit 3.

A pair of rollers 31*a*, 31*b* are disposed on opposite sides of the sheet transporting path D in a direction corresponding to the predetermined direction C. The rollers 31*a*, 31*b* are connected to a driving system (not shown), such as a driving shaft of a photoconductive drum serving as belt driving means and rotated in the counterclockwise direction in FIG. 3. Belts, more specifically four sheet turning belts, 32*a* to 32*d* extend between the rollers 31*a*, 31*b* at an interval to each other. These belts 32*a* to 32*d* are rotated in the direction orthogonal to the predetermined direction C (namely, in the counterclockwise direction in FIG. 3) by the rotation of the rollers 31*a*, 31*b*. Between the belts 32*b*, 32*c*, a sheet transporting roller 33 is positioned. The sheet transporting roller 33 (referred to simply as "transporting roller 33" below), which is rotated by a driving system not shown in the drawings, transports the sheet whose head and tail are reversed in the predetermined direction C.

A pressed 34 is mounted close to and inside the upper extension of each of the belts 32*a* to 32*d* between the rollers 31*a*, 31*b*. The presser 34 may be a plate of resin such as acrylic and is pressed against the upper extension of each of the belts 32*a* to 32*d* from the inside by pressing members including springs 35. The sheet is sent in a space between the presser 34 and the belts 32*a* to 32*d* by the rotation of the belts 32*a* to 32*d*. The transporting roller 33 rotates in contact with the upper surface of the presser 34 when the sheet is transported. The transporting roller 33 has semicircular pickup rollers 33*a*. Usually the transporting roller 33 does not come in contact with the presser 34, because each of the pickup rollers 33*a* is positioned with a straight part of its peripheral surface being opposite to the presser 34. However, in the case where the sheet sent to the presser 34 is transported in the predetermined direction C, the transporting roller 33 rotates, and a arc portion each of the pickup rollers 33*a* comes in contact with the presser 34. The sheet on the presser 34 is transported in the predetermined direction C by friction force against the pressing force that the presser 34 produces by pressing the upper inside extension of each of the belts 32*a* to 32*d*.

An end 34*a* of the pressser 34 is slightly bent down close to the roller 31*a* which comes in contact with the sheet and serves as a paper guide. Because of the end 34*a*, the sheet transported from the sheet turning device along the inner surface of each of the belts 32*a* to 32*d* is assuredly guided to a space between the presser 34 and the belts 32*a* to 32*d* without deviating from the presser 34. On the other hand, an end 34*b* of the presser 34 is bent up close to the roller 31*b* which does not come in contact with the sheet and serves as a guard. The end 34*b* stops the sheet sent through the space between the presser 34 and the belts 32*a* to 32*d*. A microswitch 36 is mounted close to the end 34*b* to sense the sheet kept at the end 34*b*.

Further, a paper guide 37 is held slightly above the inner surface of the lower extension of each of the belts 32*a* to 32*d* along the predetermined direction C. The paper guide 37 prevents the belts 32*a* to 32*d* extending orthogonal to the predetermined direction C from catching the sheet from the sheet circulating unit 2. The sheet is sent along the paper guide 37.

Figure 4:
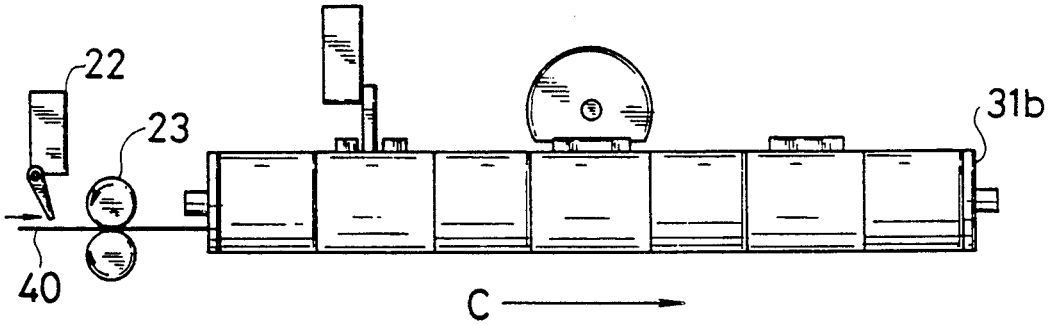
FIGS. 4(A) to 4(E) are views presented for explaining a sequential steps by which a sheet is turned in the sheet turning device.
Figure 4:
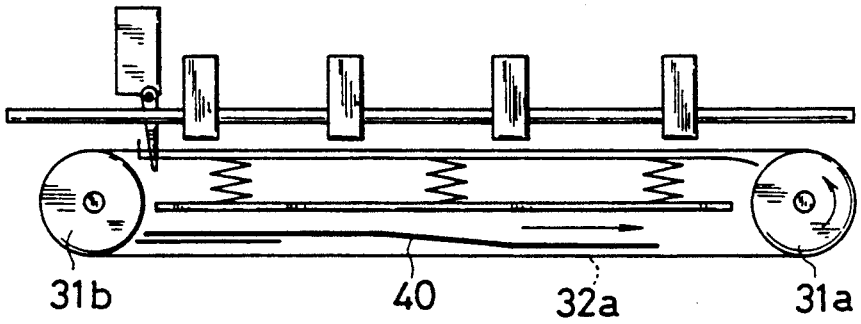
Figure 4:
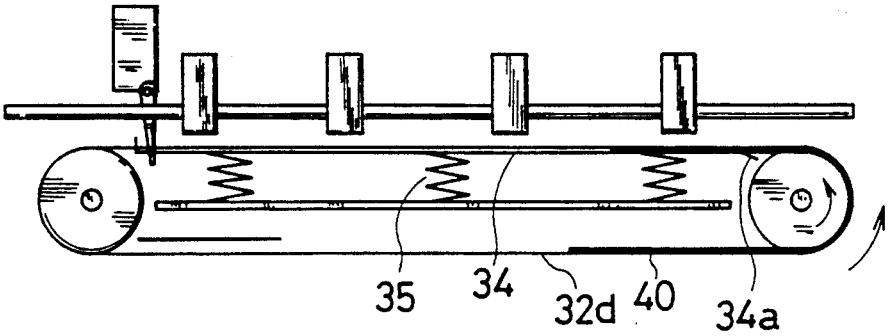
Figure 4D:
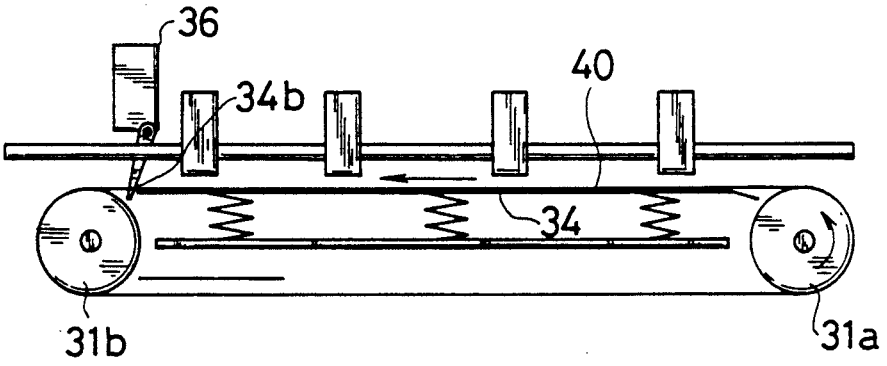
Figure 4E:
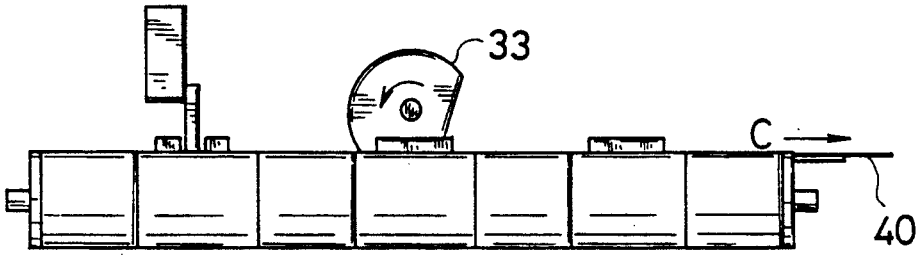

FIGS. 4(A) to 4(E) are views showing sequential steps of the operation of the sheet turning device. According to convenience of explanation, FIGS. 4(A) and 4(E) are elevational views, and FIGS. 4(B) to 4(D) are side views.

First, a sheet 40 printed with an image on one side is fed to the sheet turning device 3. The sheet 40 is sent in a direction corresponding to an arrow C along the paper guide 37 and is stopped on the inner surface of the lower extension of each of the belts 32*a* to 32*d* in accordance with a stop of the feeding roller 23 a predetermined period of time after the microswitch 22 turns off (the tail of the sheet passes the microswitch 22). At this time, the sheet 40 has a face having the image positioned on the surface of each of the belts 32*a* to 32*d* (namely, the sheet 40 lies on the face having the image) (see FIG. 4(A)).

When the rollers 31*a*, 31*b* are rotated in the counterclockwise direction, the sheet 40 begins to move along the inner surface of the extension of each of the belts 32*a* to 32*d* (FIG. 4(B)) and is sent to the space between the presser 34 and the belts 32*a* to 32*d* (FIG. 4(C)). The transportation of the sheet 40 is stopped by the end portion 34*b* of the presser 34, and simultaneously the microswitch 36 turns on (FIG. 4(D)). In accordance with the turning on of the microswitch 36, the rollers 31*a*, 31*b* are stopped. At this time, the sheet 40 has the face having no image positioned on the surface of the belts 32*a* to 32*d*, namely, the sheet 40 is turned compared to the original state shown in FIG. 4(A).

Lastly, the feeding roller 33 rotates to move the sheet 40 on the presser 34 in the predetermined direction C (FIG. 4(E)) to the printing unit 1 so that the sheet 40 lies on the face having no image therein.

Thus, the sheet turning device 3 can turn a sheet in the above mentioned manner. In this sheet turning device 3, the head and tail of the sheet is kept unchanged, and therefore there is no need to rearrange an original image upside down. The sheet turning device 3 can be advantageously miniaturized because it does not require many trays and sheets are transported along and inside the sheet turning belts unlike a device disclosed in Japanese Examined Patent Publication No. 22787/1980.

Although there are four of the sheet turning belts 32*a* to 32*d* extending between the rollers 31*a*, 31*b* in this embodiment, one belt may be substituted for them. An advantage of using a plurality of belts is that troubles such as a jam are easily settled.

As has been described, the sheet turning device 3 turns a sheet without changing the head and tail of the sheet with regard to a predetermined direction in which sheets are transported, and therefore there is no possibility that an image is produced upside down when the sheet turning device 3 is employed in an imaging machine or the like. Additionally, there is another advantage that the sheet turning device can be miniaturized because the sheet is turned by transporting it along the inner surface of the belts extending between the rollers.

What is claimed is:

1. A sheet turning device in a sheet transporting path for receiving a sheet transported in a predetermined direction, turning said sheet and transporting said sheet in said direction, comprising:

a pair of rollers disposed on opposite sides of said sheet transporting path along said predetermined direction, a belt extending between said rollers for turning said sheet, means for stopping said sheet transported onto the lower inner surface of said sheet turning belt, means for circulating said sheet turning belt to transport said sheet kept on the lower inner surface of said sheet turning belt in a direction orthogonal to said predetermined direction so that said sheet turns, a pressing member for stopping and pressing said sheet which is turning and moving, on the upper inner surface of said sheet turning belt, and a sheet transporting roller for pressing said sheet against said pressing member to transport said sheet pressed by said pressing member in said predetermined direction in spite of pressing said sheet against said upper inner surface by said pressing member.

2. A device according to claim 1, wherein said sheet returning belt includes a plurality of narrow belts independent of each other.

3. A device according to claim 2, wherein said independent belts allow said sheet transporting roller to come in contact with said pressing member through a space therebetween.

4. A device according to claim 1, wherein said pressing member includes a plate and a spring pressing said plate upward.

5. A device according to claim 1, wherein said pair of rollers includes a roller which comes in contact with said sheet moving along said inner surface of said sheet turning belt when said sheet turning belt circulates and a roller which does not, and said pressing member has a guide slightly bent down in its end close to said contact roller for guiding said moving sheet to a space between said pressing member and said upper inner surface of said sheet turning belt.

6. A device according to claim 1, wherein said pair of rollers includes a roller which comes in contact with said sheet moving along said inner surface of said sheet turning belt when said sheet turning belt circulates and a roller which does not, and said pressing member includes a guard bent up in its end close to said non-contact roller for stopping said sheet at its head between said pressing member and said upper inner surface of said sheet turning belt.

7. A device according to claim 1, wherein said sheet transporting roller includes a pickup roller having a semicircular cross section, of which straight peripheral surface is opposed to said pressing member when said sheet turning belt circulates.

8. A device according to claim 1, further comprising a paper guide plate disposed above said lower inner surface of said sheet turning belt for preventing said sheet turning belt from catching said sheet transported in said predetermined direction.

* * * * *